United States Patent [19]

Gregor et al.

[11] 4,359,364

[45] Nov. 16, 1982

[54] GAS-COLLECTING APPARATUS FOR COKING INSTALLATION

[75] Inventors: Karl Gregor, Bochum; Karl Feldhaus, Gelsenkirchen, both of Fed. Rep. of Germany

[73] Assignee: Gewerkschaft Schalker Eisenhutte, Gelsenkirchen, Fed. Rep. of Germany

[21] Appl. No.: 240,247

[22] Filed: Mar. 3, 1981

[30] Foreign Application Priority Data

Mar. 8, 1980 [DE] Fed. Rep. of Germany ..... 3009021

[51] Int. Cl.[3] ..... C10B 39/00; C10B 39/12; C10B 39/18; C10B 41/00

[52] U.S. Cl. ..... 202/230; 202/263

[58] Field of Search ..... 202/230, 263, 270; 266/157-159; 414/212

[56] References Cited

U.S. PATENT DOCUMENTS

| | | | |
|---|---|---|---|
| 3,676,305 | 7/1972 | Cremer | 202/263 |
| 3,951,751 | 4/1976 | Jakimowicz et al. | 202/263 |
| 3,981,778 | 9/1976 | Schulte et al. | 202/263 |
| 4,069,108 | 1/1978 | Riecker | 202/263 |
| 4,087,333 | 5/1978 | Naevestad | 202/263 |
| 4,196,053 | 4/1980 | Grohmann | 202/263 |

FOREIGN PATENT DOCUMENTS

| | | |
|---|---|---|
| 1948689 | 4/1971 | Fed. Rep. of Germany . |
| 2029432 | 12/1971 | Fed. Rep. of Germany . |
| 2021863 | 12/1971 | Fed. Rep. of Germany . |
| 2418323 | 4/1975 | Fed. Rep. of Germany . |
| 2543834 | 4/1977 | Fed. Rep. of Germany . |
| 2545286 | 4/1977 | Fed. Rep. of Germany . |
| 7732774 | 2/1979 | Fed. Rep. of Germany . |
| 2713466 | 5/1979 | Fed. Rep. of Germany . |

*Primary Examiner*—Bradley Garris

*Attorney, Agent, or Firm*—Karl F. Ross

[57] ABSTRACT

A coking installation has a coking chamber whose coke side opens above a bench level that is above ground level. A coke-guide track at this bench level supports a coke guide which is displaceable along the track and alignable with the coke side of the chamber. A ground-level quenching-car track supports a quenching car which can be displaced along the car track to receive coke pushed from the chamber through the guide. A gas-collecting apparatus has an outer track supported on the ground outside the coke-guide quenching-car tracks. A portal support is displaceable along this outer track and has outrigger arms carrying a gas-collecting hood above the quenching car. The gas-treatment plant has a stationary conduit provided on the ground underneath the portal support and is connected via a movable conduit to the hood on the support.

12 Claims, 5 Drawing Figures

GAS-COLLECTING APPARATUS FOR COKING INSTALLATION

FIELD OF THE INVENTION

The present invention relates to a coking installation. More particularly this invention concerns a gas-collecting apparatus for aspirating the gases generated when the charge in a coke-oven chamber is pushed through a coke guide into a quenching car.

BACKGROUND OF THE INVENTION

In a coking operation considerable noxious gases are generated as the charge of coke is pushed from the chamber through the coke guide into the quenching car. Thus it is standard procedure to provide an aspirating arrangement which normally includes a hood positioned over the quenching car at the coke side of the coking chamber so as to aspirate the steam and other gases generated as the hot coke moves out of the coking chamber, through the coke guide, and into the quenching car. Normally the coke chamber opens at its coke side, as opposed to its opposite pusher side, above a so-called bench level which is substantially above ground level. Tracks provided at this bench level support the coke guide which normally also forms part of the door-removing machine. The quenching car is normally supported on rails of a track at ground level next to and below the tracks for the coke guide.

Sometimes the hood is mounted on a carriage which moves along with the quenching car and/or coke guide. Means for treating the collected gases may also be movable along the coke-oven battery in this manner in some installations.

In a known system (see German Pat. No. 2,713,466 and German printed application No. 2,418,323) a complex structure is built which supports tracks for the hood well above the ground, and indeed above the center of gravity of the gas-collecting apparatus. This structure also supports a stationary conduit to which the gas-collecting apparatus is connected. The entire arrangement is therefore not only very bulky, but relatively expensive to manufacture as the structure needed to support all this equipment above the ground is quite complex and must be of heavy-duty construction.

It is also possible to support the gas-collecting apparatus to either side of the quenching wagon (see German utility model 7,732,774). In this system also substantial structure supports the rails for the gas-collecting apparatus at the level of the roof of the coking battery, while the gas-collecting apparatus is in turn displaceable on a frame riding on these rails but extending transverse to these rails. Such an arrangement normally is connected to an elevated stationary collecting conduit. In this arrangement moving the quenching car underneath this apparatus becomes relatively difficult and limits the size of the quenching car. It is also known (see German published patent application No. 2,543,834) to support the hood partly at least on the tracks for the quenching car. This makes it necessary to move the quenching car and gas-collecting apparatus dependently on each other. Other arrangements (see German published patent application No. 2,545,286) again entail complex structures which also carry the stationary conduit of the collecting conduit.

All of these devices are relatively complex and frequently make it difficult to service the other machinery of the coking plant. At the very least they normally deny any access to the quenching car and guide when the gas-treatment apparatus is in place, and indeed normally prevent motion of these devices independently of the gas-collecting apparatus.

OBJECTS OF THE INVENTION

It is therefore an object of the present invention to provide an improved gas-collecting apparatus for a coking installation.

Another object is to provide such an apparatus which is substantially simpler and which interferes less with the other parts of the coking installation less than the prior-art gas-collecting apparatuses.

SUMMARY OF THE INVENTION

These objects are attained in a coking installation having a coking chamber having a coke side opening above a bench level which is located above ground level. A coke-guide track is provided at the bench level and a coke guide can be displaced along this track and aligned with the coke side of the chamber. A ground-level quenching-car track carries a quenching car which is displaceable at ground level along the car track to receive coke pushed from the chamber through the guide. In accordance with the instant invention the apparatus comprises an outer track supported on the ground and lying outside the coke-guide and quenching-car tracks. A portal support is displaceable along this track and carries a gas-collecting hood which is supported on this support over the quenching car. Gas-treatment means including a conduit is connected to the hood for aspirating gases generated at the quenching car.

Contrary to the prior-art gas-collecting installations wherein the track for the gas-collecting apparatus is supported on a complex structure up at bench level, in accordance with the instant invention this track is inexpensively supported directly on the ground. Thus at least one of its tracks lies directly on the ground, although in accordance with the instant invention it is possible to elevate one of the others on rigid posts. This is possible because the instant invention employs a portal as a support. Such a portal allows the gas-collecting hood very easily to be supported at the necessary height for efficient aspiration of gases generated at the quenching car and guide. Increased stability of the portal-type structure can be achieved simply by increasing the horizontal spacing between its rails.

It is possible in accordance with the invention to provide the gas-treatment arrangement directly on the portal support for the hood. Normally, however, the gas-treatment system is fixed. A stationary conduit extends along the outer track for the portal support and a movable conduit is connectable at any of a multiplicity of locations along this stationary conduit. To this end the stationary conduit may have an upper side which is open, but normally closed by a removable cover. The portal support is provided with means for automatically opening this cover and connecting the movable conduit to the open portion of the stationary conduit at any location therealong. The stationary conduit is, according to this invention, mounted underneath the horizontal stage part of the portal support, although it may be elevated slightly or even supported with one of the tracks at an elevation slightly above ground level.

In a system having a coke wharf, it is advisable according to this invention to mount the near rail of the outer track at some elevation above this coke wharf. In such an arrangement the conveyor belt at the lower edge of the coke wharf would lie underneath the portal support and between its legs.

As mentioned above the portal support according to the instant invention includes a horizontal stage and a pair of legs. Each of these legs is a structure elongated in the direction of the respective track rail. Rigidifying struts can carry the movable conduit, and appropriate outriggers are provided for supporting the hood over the quenching car. The hydraulic controls and such are provided on the outer side of this stage to counterbalance the outrigger structure for the hood. They could even be provided on an outrigger projecting in the opposite direction to maintain the center of gravity of the gas-collecting support and hood between the outer tracks.

In order to connect the movable conduit carried on the portal support with the flexible conduit this flexible conduit has its upper side closed by an elongated flexible and liftable cover. A carriage rides along the stationary conduit and lifts up a portion of the cover as it moves along the stationary conduit. The movable conduit is connected to this carriage so as to form a relatively gastight connection with the stationary conduit. The provision of the stationary conduit well below bench level makes servicing it substantially easier, especially when considerable steam and the like is being generated during a coking operation.

With the system according to the instant invention substantial room is left for all of the equipment necessary for operating the coking installation. At the same time the various devices do not interfere with one another and can all be moved along the coking oven independently of one another.

SPECIFIC DESCRIPTION

Figures 1, 2:
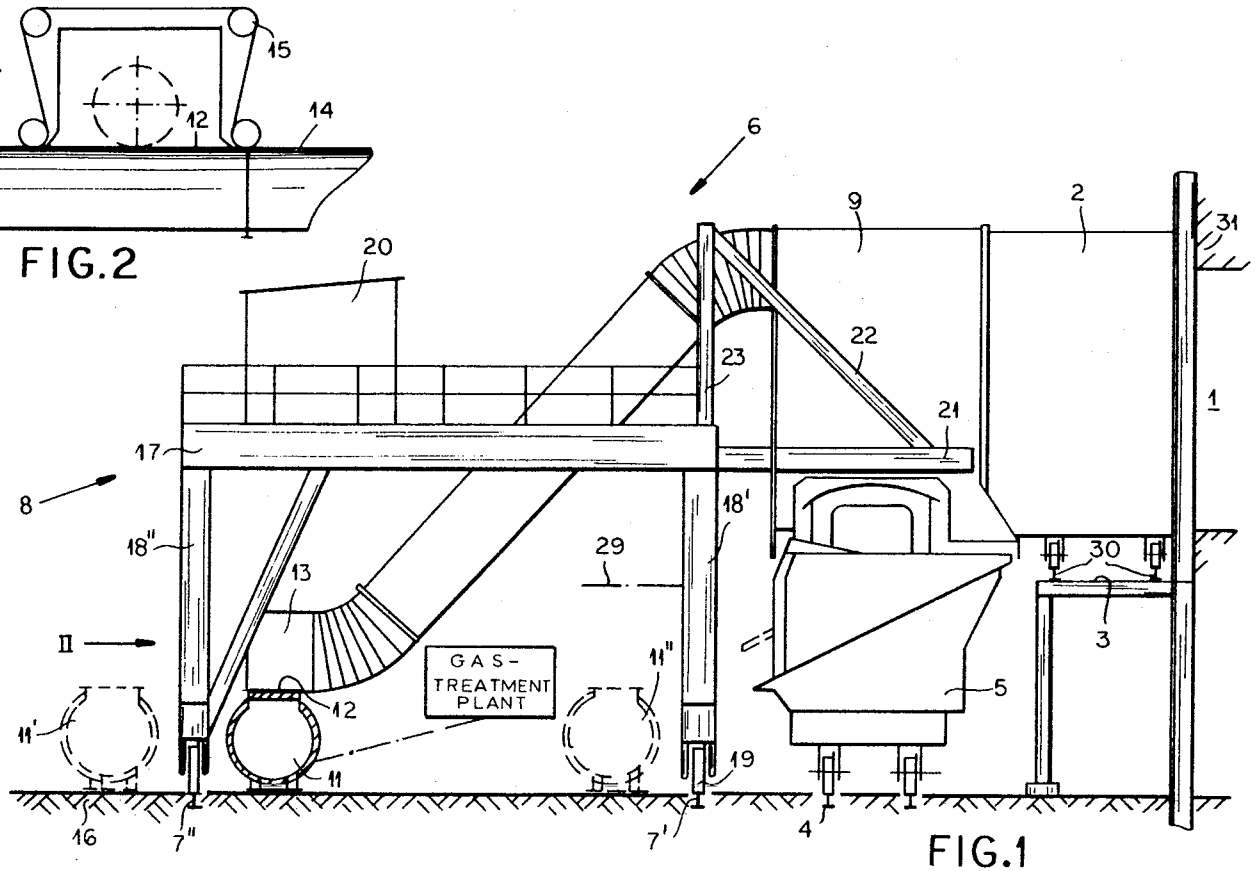
FIG. 1 is a cross section through a coking installation according to the instant invention.
FIG. 2 is a view taken in the direction of arrow II of FIG. 1.

As seen in FIG. 1 a coke-oven chamber 1 opens at its coke side above a level 29 normally termed the bench level and lying well above ground. A coke guide 2 can ride on tracks 30 on a bench-level support 3 and is alignable with the coke chamber 1 in the standard manner. A quenching car 5 can ride on ground-level quenching-car tracks 4 below and slightly outward from the coke guide 2. Normally a plurality of such coking chambers 1 are provided in a single coke-oven battery 31.

According to this invention a gas-collecting apparatus 6 has a portal-type support 8 that can travel along on an inner rail 7' and an outer rail 7'' forming an outer track. This gas-collecting apparatus 6 supports a hood 9 above bench level 29 and above the quenching car 5. A conduit 10 fixed to the portal support 8 and movable therewith can connect the open side 12 of a stationary conduit 11 by means of an opening carriage or wagon 13 shown in more detail in FIG. 2. The upper side 12 of the conduit 11 is covered by a removable cover 14 of the roller-blind type. The carriage 13 has rollers 15 which deflect this cover 14 upwardly so that the conduits 10 and 11 are connected together.

According to this invention the portal support 8 comprises a horizontal stage 17 supported on an inner leg 18' and an outer leg 18'', both provided with wheels 19 engaging the respective rails 7' and 7''. A control cabin 20 incorporating most of the heavy hydraulic equipment for displacing the portal 8 is provided toward the outside rail 7'' to counterbalance the hood 9.

The portal support 8 is provided with outrigger arms 21 which are rigidified by struts 22 extending upwardly to posts 23 forming vertical continuations of the legs 18'. Thus the hood 9 is cantilevered over the quenching car 5 but the entire arrangement still remains quite stable.

FIG. 1 shows at 11' and 11'' how the stationary conduit can be mounted outside the outer rail 7'' or adjacent the inner rail 7'. In any case it is provided below the stage 17.

Figure 3:
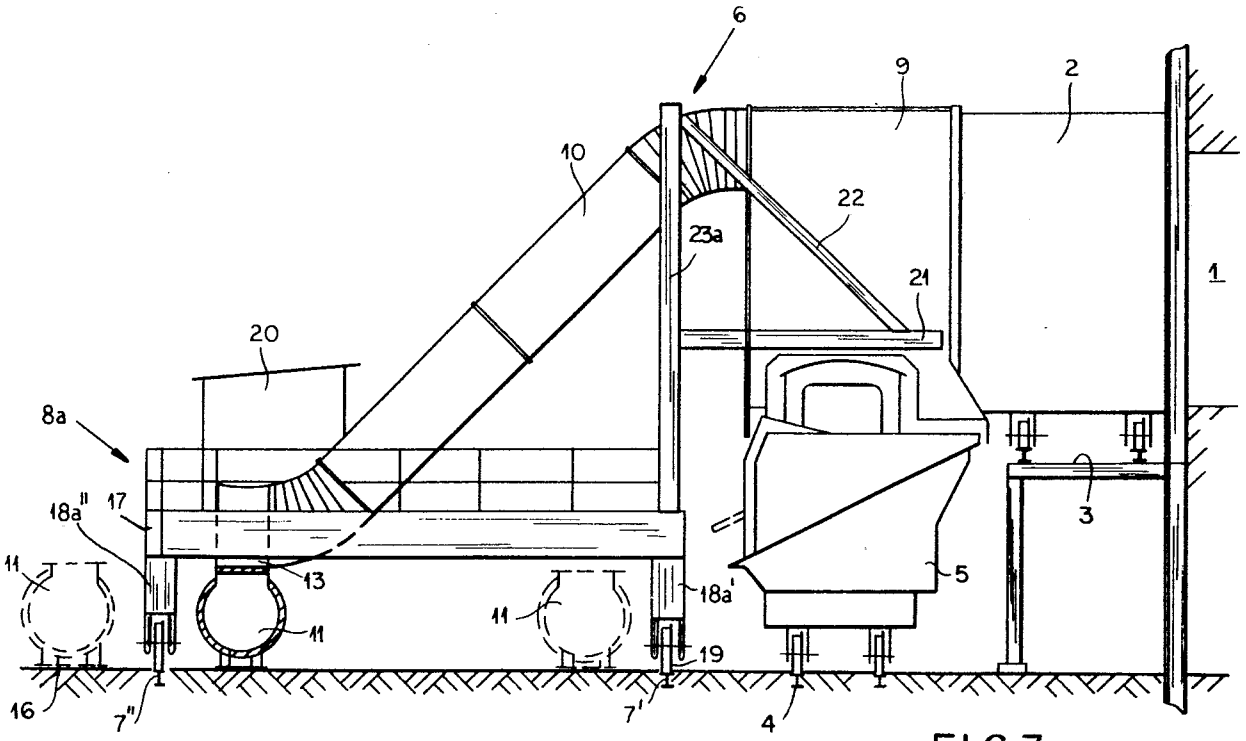
FIGS. 3, 4, and 5 are views similar to FIG. 1 but showing further arrangements according to the instant invention.

FIG. 3 shows how a portal **8*a* can have relatively short legs 18*a*' and 18*a*'' just high enough to clear the stationary conduit 11. In this case a relatively tall post 23*a* is provided for supporting the hood 9. In all other respects the system is identical to that of FIGS. 1 and 2**.

Figure 4:
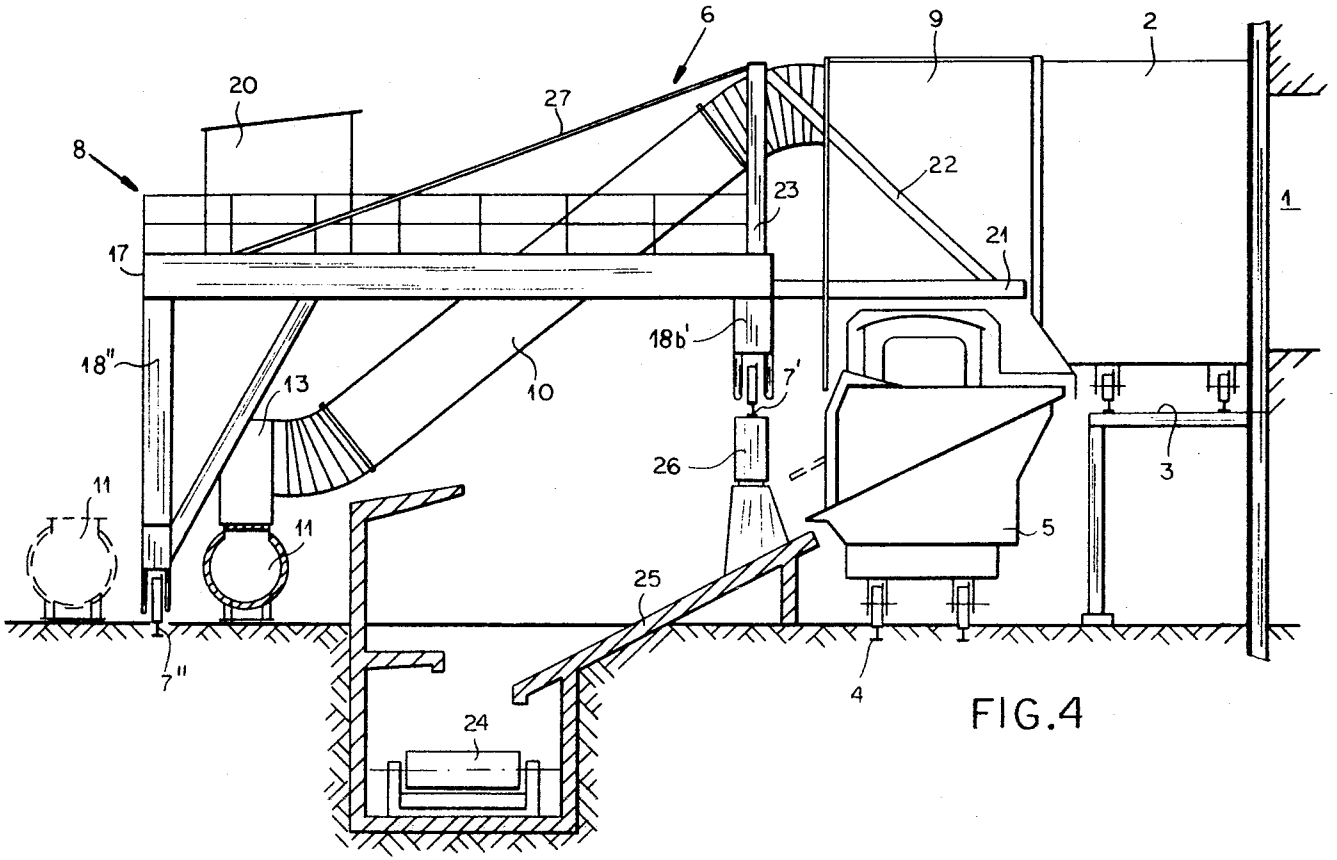

FIG. 4 shows yet another arrangement wherein a conveyor belt 24 is recessed in the ground below and between the rails 7' and 7'', and a coke wharf 25 is provided so that the quenching car 5 can dump its load down onto the conveyor belt 24. In order to prevent the track 7' from being fouled it is elevated on a relatively short post 26. A relatively short leg **18*b*' is used in this system, but otherwise the arrangement is identical to that of FIGS. 1 and 2**.

Figure 5:
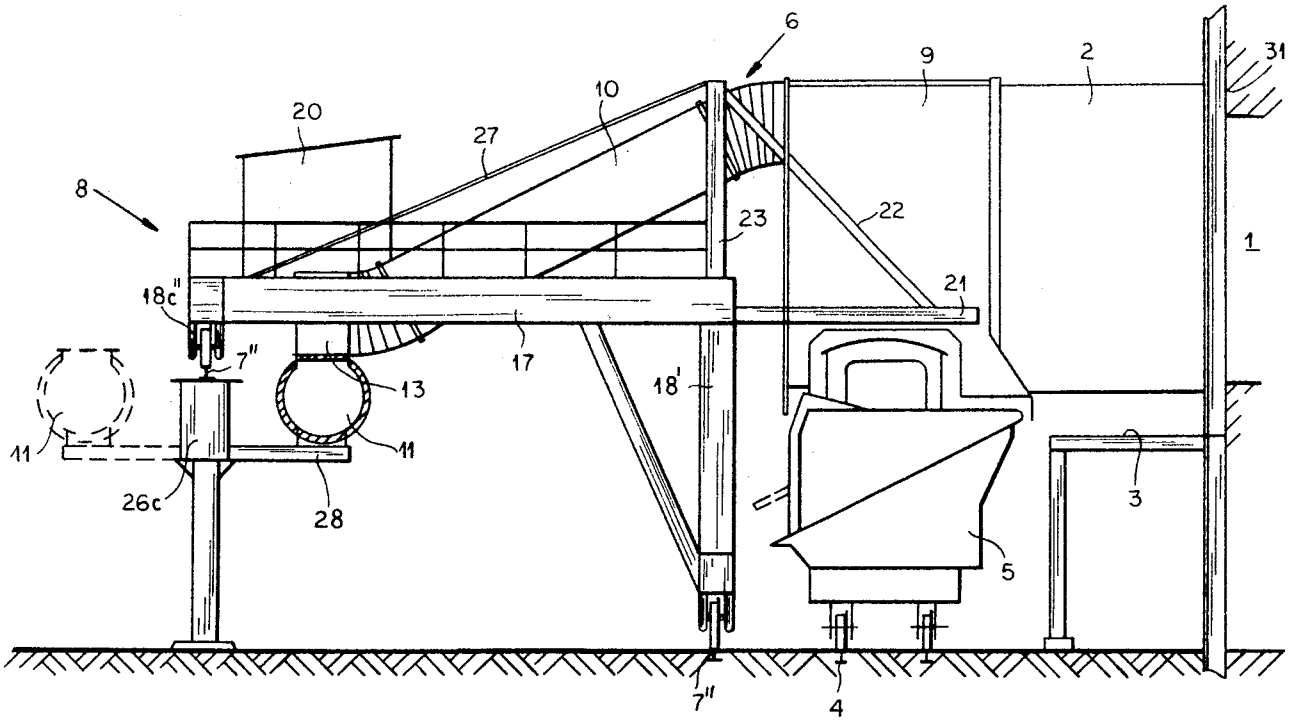

In FIG. 5 the outer track 7'' is supported up at bench level on a post **26*c* provided with a horizontal outrigger 28 carrying the stationary conduit 11. This conduit 11 may also be carried as shown in dashed lines on the outside of the track 7'. For this arrangement an extremely short outer leg 18*c*'' is employed at the outer rail 7''. It is understood that the legs 18' and 18*c*'' are elongated along the respective rails 7' and 7'', and each have at least two wheels 19**.

With the system according to the instant invention it is therefore possible to support the hood with considerable stability above the quenching car 5. At the same time the various parts of the coking installation can all move relative to one another.

We claim:

1. In combination with a coking installation having:

a coking chamber having a coke side opening above a bench level in turn above ground level;

a coke-guide track at said bench level;

a coke guide displaceable along said track and alignable with said coke side opening of said chamber;

a ground-level quenching-car track; and a quenching car displaceable at ground level along said quenching-car track to receive coke pushed from said chamber through said guide;

a gas-collecting apparatus comprising:

an outer track supported at said ground level and including a pair of rails at least one of which is at said ground level, said coke-guide and quenching-car tracks lying between said pair of rails and said coking chamber;

a portal support displaceable along said outer track and including a pair of legs each provided with a wheel and a horizontal stage interconnecting said legs, said wheels riding on said rails;

a gas-collecting hood supported on said support over said quenching car; and gas-treatment means connected to said hood for aspirating gases generated at said quenching car, said gas-treatment means including:

a stationary conduit extending along said outer track under said stage, a movable conduit carried on said support and connected at one end to said hood and having another end, and means for connecting said other end of said movable conduit to said stationary conduit at any of a multiplicity of locations therealong.

2. The apparatus defined in claim 1 wherein said stationary conduit is generally at ground level.

3. The apparatus defined in claim 1 wherein said stationary conduit is supported above ground level.

4. The apparatus defined in claim 3, further comprising a post standing on the ground and having an upper end supporting a rail of said outer track and said stationary conduit.

5. The apparatus defined in claim 1 wherein said portal support has an outrigger arm extending over said quenching car and carrying said hood.

6. The apparatus defined in claim 1 wherein said means for connecting includes a carriage displaceable along said stationary conduit having an openable upper side.

7. The apparatus defined in claim 1 wherein said outer track includes a pair of rails flanking said stationary conduit.

8. The apparatus defined in claim 1 wherein said movable conduit is generally rigid.

9. The apparatus defined in claim 1, further comprising:

a conveyor at ground level extending along said outer track adjacent said quenching-car track; and a coke wharf extending between said quenching-car track and said conveyor.

10. The apparatus defined in claim 1 wherein said stationary conduit has an open upper side and is provided with a liftable cover covering said open upper side, said means for connecting including means for automatically lifting a portion of said cover.

11. The apparatus defined in claim 1 wherein both of said rails are at ground level.

12. The apparatus defined in claim 1, further comprising a support holding one of said rails above ground level.

* * * * *